United States Patent [19]

Hendrickson et al.

[11] Patent Number: 5,009,842

[45] Date of Patent: Apr. 23, 1991

[54] METHOD OF MAKING HIGH STRENGTH ARTICLES FROM FORGED POWDER STEEL ALLOYS

[75] Inventors: Alfred A. Hendrickson, Lake Leelanau; Darrell W. Smith, Chassell, both of Mich.

[73] Assignee: Board of Control of Michigan Technological University, Houghton, Mich.

[21] Appl. No.: 535,379

[22] Filed: Jun. 8, 1990

[51] Int. Cl.[5] ..... B22F 3/24

[52] U.S. Cl. ..... 419/28; 419/26; 419/29; 419/36; 419/37; 419/38; 419/54; 419/57; 419/58

[58] Field of Search ..... 419/26, 28, 29, 36, 419/37, 38, 54, 57, 58

[56] References Cited

U.S. PATENT DOCUMENTS

| | | | |
|---|---|---|---|
| 3,837,068 | 9/1974 | Dunn | 29/420.5 |
| 3,992,763 | 10/1976 | Haynie et al. | 29/420.5 |
| 4,002,471 | 1/1977 | Sarnes et al. | 75/200 |
| 4,165,243 | 8/1979 | Sarnes et al. | 148/16.5 |
| 4,587,096 | 5/1986 | Mankins et al. | 419/27 |
| 4,693,864 | 9/1987 | Lloyd | 419/23 |
| 4,756,677 | 7/1988 | Hribernik et al. | 419/8 |
| 4,879,091 | 11/1989 | Samal et al. | 419/19 |

*Primary Examiner*—Stephen J. Lechert, Jr.
*Assistant Examiner*—Leon Nigohosian, Jr.
*Attorney, Agent, or Firm*—Michael, Best & Friedrich

[57] ABSTRACT

High strength steel parts or articles are made from a powder alloy by compacting the powder into a preform, sintering the preform in a sintering furnace or the like under a highly-reducing atmosphere and at a temperature of at least 1150° C., cooling the preform, preheating the sintered preform in a highly-reducing atmosphere, such as an inert gas-based atmosphere containing hydrogen or pure hydrogen, to a temperature of at least 1000° C. and transferring the preheated preform to an impact forging device and impacting the preform at a peak averaging forging pressure of at least about 1000 MPa to obtain a forged part or article. The time period between removal of the preheated preform from the preheater and the first forging impact is no more than about 8 seconds. The sintering and preheating steps can be combined with the sintered preform being cooled to the preheating temperature in the sintering furnace and transferred directly from the sintering furnace to the impact forging device.

15 Claims, No Drawings

METHOD OF MAKING HIGH STRENGTH ARTICLES FROM FORGED POWDER STEEL ALLOYS

BACKGROUND OF THE INVENTION

This invention relates to powder metallurgy and, more particularly, to methods for forging articles from powder steel alloys.

Powder forging is a process in which a porous preform produced by cold compaction and sintering is hot forged to reduce the pore content and increase strength. While over three decades old, powder forging still is an emerging technology. The growth of powder forging has been impeded by a number of factors including questions concerning the economic viability of the process, technical problems and process limitations. Pease, "An Assessment of Powder Metallurgy Today and Its Future Potentional", SAE Publication 831042 (1984). Despite these difficulties, powder forging has important advantages such as demonstrated capabilities in producing near-net or net shapes, excellent material and energy utilization and adaptability to automated production. Prior methods employing press forging are exemplified in U.S. Pat. Nos. 4,693,864 (Lloyd), 4,165,243 (Sarnes et al.), 4,002,471 (Sarnes et al.), 3,992,763 (Haynie et al.) and 3,837,068 (Dunn).

Currently, powder forging is carried out on forging presses, mainly mechanical and hydraulic presses. Use of impact forging, commonly applied to the conventional impression die forging of wrought steels, has a number of potentially important technical and economic advantages. One example is the ability of impact forging machines to achieve large forging forces at lost cost. This capability enables the use of large peak average forging pressures which favor the development of high densities and strengths in the forged part. Hendrickson et al., "Effect of Pressing Variables on the Mechanical Properties of P/M Forged and Heat Treated 4650-60 Steels", Horizons of Powder Met., Part 1 Proc. P/M, pp. 453-56 (1986). Despite these important advantages, impact forging has not been used for commercial powder forging.

SUMMARY OF THE INVENTION

An object of the invention is to provide an economical method for producing articles from forged powder steel alloys with impact forging.

Another object of the invention is to provide such a method which is capable of producing high strength steel articles having high tensile ductility and toughness and improved fatigue life.

A further object of the invention is to provide a method which is capable of producing steel articles having such properties while utilizing true forging strains as low as 0.1.

Other objects, aspects and advantages of the invention will become apparent to those skilled in the art upon reviewing the following detailed description and the appended claims.

The invention provides a method for producing high strength articles from forged powder steel alloys including the steps of compacting the powder into a coherent preform, heating the preform in a sintering furnace or the like in a substantially dry, highly-reducing atmosphere and at a temperature of at least 1150° C. preferably about 1250° to about 1400 ° C., to sinter the preform, allowing the sintered preform to cool, preheating the sintered preform in a preheating furnace or the like in the presence of substantially dry, highly-reducing atmosphere, such as an inert gas-based atmosphere containing hydrogen or pure hydrogen, to a temperature of at least about 1000° C., preferably about 1100° to about 1200° C., and transferring the preheated, sintered preform from the preheating furnace to an impact forging device and impacting the preform therein at a peak average forging power of a least about 1000 MPa, preferably 1000 to about 2000 MPa, to obtain a forged article. The time period between removing the preheated, sintered preform from the preheating furnace and the first forging impact is no more than about 8 seconds.

In an alternate embodiment, the sintering and preheating steps are combined and the sintered preform is allowed to cool in the sintering furnace to the preheating temperature and then transferred directly from the the preheating furnace to the compact forging device.

DETAILED DESCRIPTION

Various conventional steel powder composition alloys can be used. The particular formulation of the powder depends primarily on the characteristics desired in the final article. Suitable powders include AISI No. 4600 series which typically contain from 0 up to about 0.5% manganese, about 0.25 to about 2.25% nickel, about 0.25 to 0.70 % molybdenum and, up to about 1.25% carbon with the balance being iron along with conventional impurities, except that the maximum sulfur content preferably is about 0.0075 weight %. While the powder can be a mixture of alloying constituents for producing the desired alloying chemistry, it preferably is a prealloyed powder produced by first alloying the iron and other metals in a conventional manner and then atomizing the alloy.

The alloy powder is mixed with a suitable lubricant, such as a conventional waxy or fatty material, which burns off during the sintering step. A suitable binder and/or a sufficient amount of graphite to adjust the carbon content to within a predetermined range can be admixed with the powder.

The alloy powder is then compacted into a coherent green briquette or preform by compressing in a die. The preform is formed into a size and configuration suitable for forging into a finished part of the desired configuration. The compacting operation typically is controlled to produce a preform having a density up to about 90% of the theoretical density. The compaction can be either uniaxial or isostatic. As discussed in more detail below, the configuration and dimensions of the preforms can be quite close to that desired for the final part or article.

After compacting, the preform is placed in a sintering means, such as a conventional sintering furnace which typically includes a preheating zone for buring off the lubricant, a hot zone for sintering and a cooling zone. Sintering is carried out in a substantially dry, highly-reducing atmosphere to prevent undesirable oxidation, at a temperature of at least 1150° C., preferably about 1250° to about 1400° C., and for a time period sufficient to effect diffusion bonding of the powder particles at their points of contact and form an integrally sintered mass. A particularly suitable atmosphere for sintering is dry associated ammonia having a dew point in the order of −40° C.

Following sintering and prior to forging, the preform is preheated in a suitable preheating device, such as an induction heating furnace. The preheating is carried out in a substantially dry, highly-reducing atmospheres and at a temperature of at least 1000° C, preferably about 1100° to about 1200° C. Various highly-reducing atmospheres can be used in the preheating step. At present, an inert gas-based atmosphere containing hydrogen and pure hydrogen are preferred.

The preheated preform is transferred from the preheating furnace to a conventional impact forging device. This transfer can be made with any suitable parts feeder, such as a pick and place robot to automate the forging process. The preform is formed into the desired shaped part or article by the impact forging device which can be one of various conventional impact forging devices, such as gravity and power anvil hammers, e.g., Die Forger manufactured by Chambersburg Engineering Company, and counter blow hammers and horizontal, counter blow forging machines, e.g., Impacter manufactured by Chambersburg Engineering Company.

The impact forging device preferably employs a closed die configuration so that net or near-net shapes can be produced. The impact forging devices should be capable of completing the densification and shaping the part or article in no more than three blows, preferably in one blow, and producing a peak average forging pressure of at least about 1000 MPa on the final blow. The short contact time between the impact forging tool and the preform minimizes or eliminates porosity near the surface at the resulting forged part or article, thereby improving near surface mechanical properties.

The die can be lubricated with a conventional lubricant, such as a graphite slurry, prior to each forging or the preform can be coated with a suitable lubricant prior to preheating for forging.

The time period between removing the preform from the preheating furnace and the first impact or blow delivered by the impact device should be no more than about 8 seconds. Longer time periods tend to cause undesirable oxidation which reduces tensile and other properties.

In an alternate embodiment, the sintering step is carried out in a substantially dry, highly-reducing atmosphere like that used in the preheating furnace, the sintered preform is allowed to cool in a cooling zone of the sintering furnace to a temperature corresponding to the preheating temperature and the cooled preform is transferred directly from the sintering furnace to the impact forging device within the time period described above.

The forged part is austenized, quenched in a conventional quenching bath and tempered to provide the desired material strength. The forged part or article has a density of at least 99.5% of the pore free or theoretical density. The mode of forging (repressing vs. upset) has no significant influence in the tensile ductility of parts or articles at high strength levels (i.e., quenched and tempered at strength levels from about 1400 to about 2000 MPa), so long as the density is at least 99.5% of the theoretical density. Finished part has density of at least about 99.5% of a pore-free density.

Tensile ductility at high strength levels can be adversely affected by sulfur contents greater than about 0.0075 weight %. When the sulfur content is less than this amount, the oxygen content is less than about 50 ppm and the forged density is at least about 7.83 g/m$^3$, tensile ductilities at the high strength values noted above comparable to those reported for heavily wrought, low sulfur 4650 steel, Hendrickson et al., "Effects of Processing Variable on the Mechanical Properties of P/M Forged and Heat Treated 4650-60 Steels", Horizons of Powder Met., pp. 4533–56 (1986), and superior to those reported for press forged powder, Buzolits et al., "Specifications for Hot-Forged Powder-Metal Steels", Progress in Powder Met. Vol 41, pp. 589–630 (1985), can be obtained. Also, steel parts having very high levels of hardness (e.g., 50–60 HRC) and tensile strengths (e.g., 1700–1950 MPa) can be produced with true forging strains as low as 0.1. "True forging strain" (FS) is determined by the equation: $FS=[\ln (h_0/h)]$ where $h_0$=initial height and h=forged height. Thus, instead of the preform being significantly larger than the desired dimensions for the forged part or article, the dimensions and configuration of the preform can be quite close to those desired for the final part or article, i.e., within about 10–15%. Apparently, low oxygen content coupled with high peak average pressures contributes to the closure and bonding of pores, even at very low lateral strains.

Without further elaboration, it is believed that one skilled in the art, using the preceeding description, can utilize the present invention to its fullest extent. The following example is presented to exemplify the invention and should not be construed as a limitation thereof.

EXAMPLE

Water atomized prealloyed 4600 powders having the following compositions were used to prepare forged parts.

| | Chemical Analysis, wt % | | | | | |
|---|---|---|---|---|---|---|
| Powder | C | S | O | Mn | Mo | Ni |
| A | 0.01 | 0.022 | 0.15 | 0.17 | 0.54 | 1.84 |
| B | 0.003 | 0.006 | 0.08 | 0.18 | 0.51 | 1.79 |

Sieve analysis showed both powders to be generally less than 100 mesh with similar particle size distribution. Approximately 0.6 weight % graphite and 0.7 weight % Acrawax (a wax-type lubricant) were admixed with the powders prior to compacting into preforms. The resulting mixture was consolidated by uniaxial compaction into preforms having a nominal density of 6.8 g/cm$^3$.

All the preforms were sintered in dry disassociated ammonia (dew point=−40° C.) for 20 minutes. One group of each powder was sintered at 1150° C. and another group was sintered at 1260° C. The sintered carbon level of all the sintered preforms was about 0.5 weight % and the sintered densities were nominally 6.8 g/cm$^3$. The overall dimensions of the sintered preforms were 1.9 cm×3.6 cm×12.4 cm and all weighed approximately 590 g.

The sintered preforms were forged in a hammer type impact forging device employing closed die tooling and gravity anvil hammer with a 6000 ft-lb energy rating. An accelerometer mounted on the hammer ram was used to monitor peak forging pressures. The preforms were forged in either a repressing or upsetting mode, resulting in forging strains of 0.15 and 0.8, respectively. The upset forging required 3 blows to obtain an adequate die fill, while the repressed forging required only a single blow. Peak average forging pressures (final blow) varied from specimen to specimen, but typically was within the range of 1400 MPa to 2100 MPa. The die was lubricated with a conventional graphite slurry prior to each forging. All preforms were heated in an induction furnace to a temperature of 1150° C. and in a dry hydrogen atmosphere before forging.

Tensile bars were machined from each forging. The bars were austenitized at 843° C. for 1 hour, quenched in agitated oil and then tempered for 2 hours at a temperature from 232° to 427° C. After tempering, gauge sections were reground sufficiently to remove scale and any decarburized layer.

Tensile tests were performed on the tensile bars with a screw driven testing machine at a strain rate of $3.3\times10^{-4}sec^{-1}$. Densities of the bars were measured with a Micromeritics 1320 Autopyconmeter. Carbon, oxygen and sulfur contents of the bars were determined with LECO apparatus.

The tensile ductility for specimens sintered at 1260° C. containing low oxygen levels (29–83 ppm), made from a powder alloy containing no more than about 0.0075 weight % sulfur and having a forging density of at least 7.83 g/cm$^3$ (99.5% of theoretical density) were comparable to that reported for heavy wrought, low sulfur 4650 steel and greater than that reported for press forged 4640 powder. It was found that, in order to obtain such low oxygen contents, the time period between removing the preform from the preheating furnace and the first forging impact or blow must be 8 seconds or less combined with sintering at a temperature of at least about 1250° C.

The process of the invention can be automated and it is anticipated that a single impact forging machine can produce from 20 to 60 parts per minute and even higher, thereby making the process quite economic. Also, impact forging equipment generally is less expensive than press forging equipment, so the initial investment for the equipment used to practice the invention should be less than that for press forging. The process is particularly adaptable in the manufacture of small to small-medium (e.g., 1/4 to 5 lb.) steel components, such as hand tools, which require high ductility at very high strength levels.

From the forgoing description, one skilled in the art can easily ascertain the essential characteristics of the invention and, without departing from the spirit and scope thereof, make various changes and modifications to adapt it to its various usages.

We claim:

1. A method for producing a high strength article from forged powder steel alloys comprising the steps of:

(a) compacting said powder into a coherent preform;

(b) heating said preform in a sintering means in a substantially dry, highly-reducing atmosphere and at a temperature of at least 1150° C. to sinter said preform and allowing said sintered preform to cool;

(c) preheating said sintered preform in a preheating means in the presence of a substantially dry, highly reducing atmosphere to a preheating temperature of at least 1000° C.; and (d) transferring said preheated, sintered preform from the preheating means to an impact forging device and impacting said preform therein at a peak average forging pressure of at least about 1000 MPa to obtain a forged article, the time period between removing said preheated, sintered preform from the preheating means and the first forging impact being no more than about 8 seconds.

2. A method according to claim 1 wherein said sintering temperature in step (b) is about 1250° to about 1400° C.

3. A method according to claim 1 wherein the atmosphere in step (c) is an inert gas-based atmosphere containing hydrogen or pure hydrogen.

4. A method according to claim 1 wherein said preheating temperature in step (c) is about 1100° to about 1200° C.

5. A method according to claim 1 wherein steps (b) and (c) are combined and said sintered preform is allowed to cool in the sintering means to said preheating temperature and then transferred directly from the sintering means to the impact forging device.

6. A method according to claim 1 wherein said peak average forging pressure is about 1000 to about 2000 MPa.

7. A method according to claim 1 wherein said preform is compressed to a density up to about 90% of the theoretical density in step (a).

8. A method according to claim 1 wherein the article has a hardness of about 50 to about 60 HRC and a tensile strength of about 1700 to 1900 MPa.

9. A method according to claim 1 where the density of the forged article is at least about 99.5% of the theoretical density.

10. A method for producing high strength articles from forged powder steel alloys comprising the steps of:

(a) compacting said powder into a coherent preform;

(b) heating said preform in a sintering means in a substantially dry, highly-reducing atmosphere and at a temperature of about 1250° to about 1400° C. to sinter said preform and allowing said sintered preform to cool;

(c) preheating said sintered preform in a preheating means in the presence of an inert gas based atmosphere containing hydrogen or substantially pure hydrogen to a preheating temperature of at least about 1000° C.; and (d) transferring said preheated, sintered preform from the preheating means to an impact forging device and impacting said preform therein at a peak average forging pressure of at least about 1000 to about 2000 MPa to obtain a forged article, the time period between removing said preheated, sintered preform from the preheating means and the first forging impact being no more than about 8 seconds.

11. A method according to claim 10 wherein said preheating temperature in step (c) is about 1100° to about 1200° C.

12. A method according to claim 10 wherein steps (b) and (c) are combined and said sintered preform is allowed to cool in the sintering means to said preheating temperature and is transferred directly from the sintering means to the impact forging device.

13. A method according to claim 10 wherein said preform is compressed to a density up to about 90% of the theoretical density in step (a).

14. A method according to claim 10 wherein the article has a hardness of about 50 to about 60 HRC and a tensile strength of about 1700 to 1900 MPa.

15. A method according to claim 14 wherein the density of the forged article is at least about 99.5% of the theoretical density.

* * * * *